United States Patent [19]

McGuire

[11] Patent Number: 4,815,998

[45] Date of Patent: Mar. 28, 1989

[54] ELECTRICALLY OPERATED COIN SAVING AND SECURITY

[76] Inventor: Michael L. McGuire, 631 Aljo Dr., Pittsburgh, Pa. 15241

[21] Appl. No.: 148,562

[22] Filed: Jan. 26, 1988

[51] Int. Cl.[4] ..... A45C 1/12; A47G 29/00

[52] U.S. Cl. ..... 446/8; 206/0.81; 109/61; 109/63.5; 232/4 R

[58] Field of Search ..... 446/8-13, 446/; 232/4 R; 206/0.81, 0.82; 109/59 R, 61, 63.5, 58; 70/289, 290

[56] References Cited

U.S. PATENT DOCUMENTS

| | | | |
|---|---|---|---|
| 1,507,279 | 9/1924 | Giclas | 446/9 |
| 3,243,914 | 4/1966 | Poynter | 446/9 |
| 4,389,194 | 6/1983 | Toll et al. | 446/8 X |
| 4,714,030 | 12/1987 | Cole | 109/61 |

*Primary Examiner*—Mickey Yu

*Attorney, Agent, or Firm*—William J. Ruano

[57] ABSTRACT

A bank containing a coin receiving base portion and a detachable top portion containing a battery operated locking system. Such system contains an electromagnetic coil lock for locking together the two portions. A switch responsive to placement of the top portion on the base portion for opening a circuit to de-energize the coil lock so as to lock the portions together. A coin slot switch is also provided to temporarily light a lamp upon dropping of a coin. A mercury switch is also provided to prevent opening of the bank when inverted.

A coin sensor is also provided on the top portion for allowing the coil lock to be activated to enable the removal of the top portion when the sensor senses the coin receiving base portion being sufficiently filled with coins.

6 Claims, 1 Drawing Sheet

ELECTRICALLY OPERATED COIN SAVING AND SECURITY

This invention relates to a bank.

SUMMARY OF THE INVENTION

The bank of the present invention is one that once the top electrically operated module is placed on the base, it cannot be removed again until the base is completely filled with coins.

DESCRIPTION OF THE PREFERRED EMBODIMENT

Figure 2:
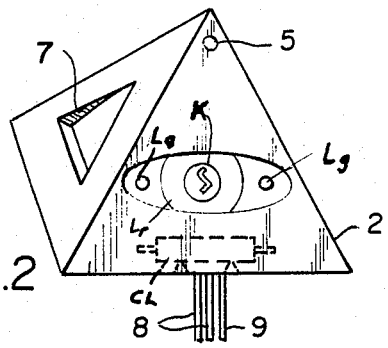
FIGS. 2 3 and 4 are a top perspective view, top view and bottom view, respectively, of the electrically equipped top portion of the bank.
Figure 3:
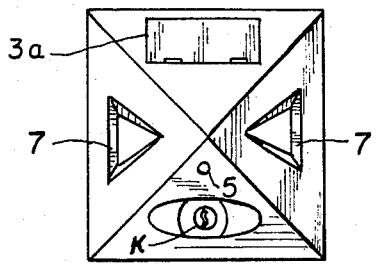
Figure 1:
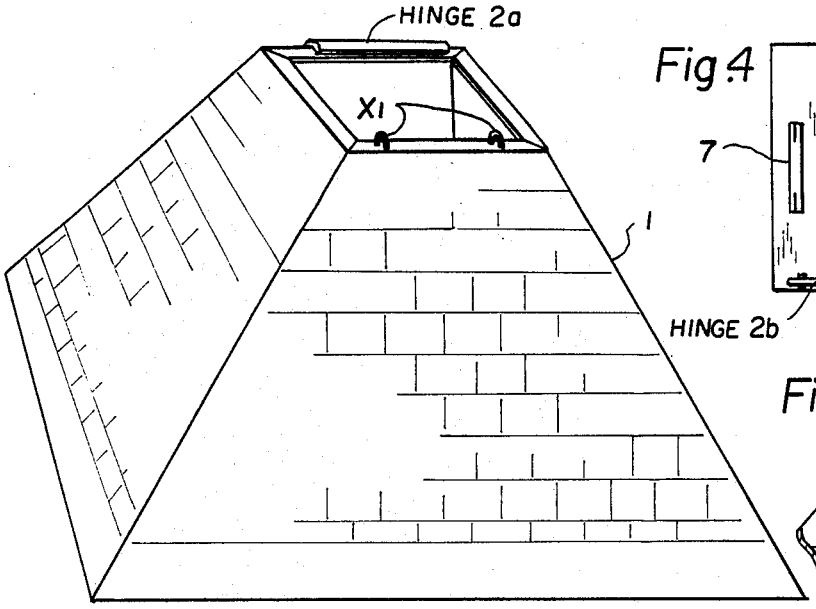
FIG. 1 is the base portion of a bank embodying the present invention.
Figure 4:
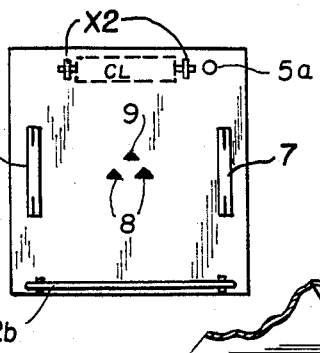
Figure 6:
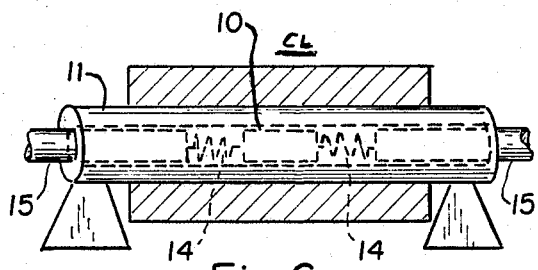
FIG. 6 is an enlarged view, partly in vertical cross-section, of the coil lock.
Figure 7:
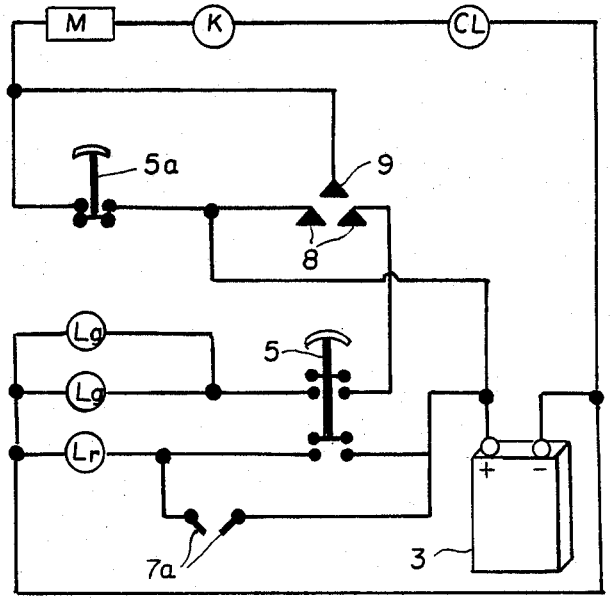
FIG. 7 is an electrical control diagram embodied on the top portion of the bank.

In operation, place battery 3 in the battery compartment. Turn key switch k to the "on" position. Power flows through the contacts of switch 5*a*, mercury switch M, and key switch k, hence energizing the coil lock CL. This will attrack steel rods 15 in tube 11 toward the center stationary rod 10, compressing springs 14 and retracting rods 15 from locking slots X2 (FIG. 4). The coil lock shown in FIG. 6 is located on the interior bottom of the module shown in FIGS. 2, 3 and 4 between locking slots X2 (FIG. 4). Locking slots X2 are small openings in the bottom of the electrically operated module to accomodate locking rings X1 (FIG. 1). Steel rods 15 shown in (FIG. 6) extend over locking slots (FIG. 4). Locking rings X1 extend through locking slots X2 when the coil lock is energized. Only when the coil lock (CL) is energized is it possible to place module on the base. When CL is energized, hinge portion 2*b* pivots on hinge portion 2*a*.

The process of placing the module on the base opens the contact points of switch 5*a*, thus de-energizing the coil lock CL and locking the module in place of the base. Turn the key to the "off" position and remove. (hide the key) The bank now cannot be opened again with the key until it is completely filled with coins.

Figure 5:
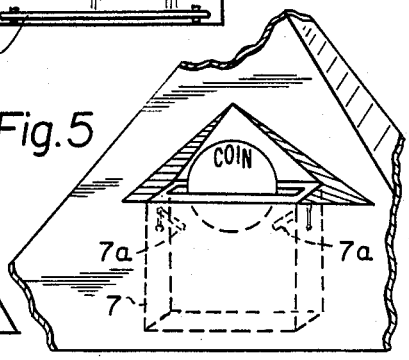
FIG. 5 is the coin slot.

The process of putting coins in the bank closes the contact points of the deposit switch 7*a* in coin slot 7 (FIG. 5) temporarily, thus causing the red lamp Lr in the iris portion of the eye to blink. Everytime a coin is deposited the eye will blink red.

Anytime during the course of filling the bank, it is possible to check to see if the base is filled enough to open. By pressing switch 5, the eye will light either red Lr; indicating not yet ready to open, or both green Lg and red Lr; indicating the base is full and ready to open with key.

A mercury switch M has been incorporated into the module to prevent the owner from turning the bank upside down and attempting to make the necessary coin contact of the coin sensor 8, 9 to remove the module. Mercury switch M is normally closed.

When a green light Lg and red light Lr are illuminated when switch 5 is depressed, indicating ready to open, place the key in keyswitch K and turn to the "on" position. Power flows through coin sensors 8, 9, mercury switch M, and key switch K. Causing the coil lock CL to energize and enabling the module to be removed.

Thus it will be seen that I have provided a novel and unique bank which is substantially fool-proof and which gives a clear indication of when it is filled with coins and wherein the electrical controls are completely contained in the top, removable portion and which cannot be opened normally until the bank is completely filled.

While I have illustrated and described a single specific embodiment of my invention, it will be understood that this is by way of illustration only and that various changes and modifications may be contemplated in my invention within the scope of the following claims.

I claim:

1. A coin bank for the savings and security of coins which comprises: a coin container portion which serves as the retainer of coins until said coin container portion has been completely filled with coins; an electrically operated cover portion energized by a power source which serves as the bank door and comprises;

an electromagnetic coil lock for locking said coin container portion and said electrically operated cover portion together, a switch contained in said cover portion which is electrically in series with said coil lock and responsive to placement of said electrically operated cover portion on said coin container portion for de-energizing said coil lock so as to lock said electrically operated cover portion and said coin container portion together, coin sensors on said cover portion which protrude into said coin container at a predetermined distance so that when said coin container portion has been completely filled, a circuit is made across said coin sensors by said coins to enable the circuit to be completed from said power source to said coil to enegize said coil to unlock said lock and enable removal of said electrically operated cover portion from said coin container portion.

2. A bank as recited in claim 1 wherein said electromagnetic coil lock comprises a horizontally mounted cylinder containing a central rod forming the core of said electromagnetic coil lock, a pair of spring biased side steel rods having ends projecting from the ends of said cylinder, and a pair of spaced rings on said coin container portion which protrude through slots in said electrically operated cover portion so that when said portions are placed together and said coil lock is deenergized, said side steel rods project through said rings for locking said portions together, and for unlocking said portions when energized.

3. A bank as recited in claim 1 wherein said electrically operated cover portion contains a mercury switch electrically connected with said electromagnetic coil lock which is positioned to prevent opening of said bank when inverted.

4. A bank as recited in claim 1 wherein said electrically operated cover portion contains a keyswitch so that only the owner of said bank can enable the energization of said coil lock if said coin container is completely filled, thus opening the bank.

5. A bank as recited in claim 4 together with a red and two green lamps connected electrically to a coin indicating switch in said cover portion, whereby when said indicating switch is activated, illumination of said red lamp indicates that the coin container is not yet filled enough to enable removal of said cover portion and illumination of both said red an green lamps indicates that the coin container is filled enough for opening with said keyswitch.

6. A bank as recited in claim 5 wherein said electrically operated cover portion contains a coin slot switch which would temporarily illuminate said red lamp upon the dropping of a coin through the coin slot.

* * * * *